US006964507B2

(12) United States Patent
Mohacsi

(10) Patent No.: US 6,964,507 B2
(45) Date of Patent: Nov. 15, 2005

(54) SIGN ILLUMINATION SYSTEM

(75) Inventor: Ferenc Mohacsi, Muskego, WI (US)

(73) Assignee: Everbrite, LLC, Greenfield, WI (US)

( * ) Notice: Subject to any disclaimer, the term of this patent is extended or adjusted under 35 U.S.C. 154(b) by 29 days.

(21) Appl. No.: 10/424,358

(22) Filed: Apr. 25, 2003

(65) Prior Publication Data

US 2004/0212998 A1 Oct. 28, 2004

(51) Int. Cl.[7] ..... F21S 8/10; F21V 21/00

(52) U.S. Cl. ..... 362/545; 362/240; 362/241; 362/247; 362/812

(58) Field of Search ..... 362/335, 237, 362/240, 241, 247, 251, 252, 812, 545, 800

(56) References Cited

U.S. PATENT DOCUMENTS

| | | | | |
|---|---|---|---|---|
| 1,374,654 | A | 4/1921 | Harrison | |
| 2,205,830 | A | 6/1940 | Flannery | |
| 2,205,860 | A | 6/1940 | Olds | |
| 4,811,179 | A | 3/1989 | Komatsu et al. | |
| 4,920,404 | A | 4/1990 | Shrimali et al. | |
| 5,365,411 | A | 11/1994 | Rycroft et al. | |
| 5,428,912 | A | 7/1995 | Grondal et al. | |
| 5,467,544 | A | 11/1995 | Treuberg | |
| 5,539,623 | A | 7/1996 | Gurz et al. | |
| 5,697,175 | A | 12/1997 | Schwartz | |
| 5,703,719 | A * | 12/1997 | Chen | 359/547 |
| 5,711,588 | A * | 1/1998 | Rudisill | 362/30 |
| 5,857,767 | A | 1/1999 | Hochstein | |
| 5,967,648 | A | 10/1999 | Barnes, II et al. | |
| 6,095,666 | A | 8/2000 | Salam | |
| 6,139,166 | A | 10/2000 | Marshall et al. | |
| 6,287,947 | B1 | 9/2001 | Ludowise et al. | |
| 6,351,069 | B1 | 2/2002 | Lowery et al. | |
| 6,361,190 | B1 * | 3/2002 | McDermott | 362/310 |
| 6,367,950 | B1 * | 4/2002 | Yamada et al. | 362/245 |
| 6,394,626 | B1 | 5/2002 | McColloch | |
| 6,443,593 | B1 * | 9/2002 | Lauschner | 362/239 |
| 6,489,636 | B1 | 12/2002 | Goetz et al. | |
| 6,583,521 | B1 | 6/2003 | Lagod et al. | |
| 6,598,998 | B2 | 7/2003 | West et al. | |
| 6,607,286 | B2 | 8/2003 | West et al. | |
| 6,623,150 | B2 * | 9/2003 | Roller et al. | 362/520 |

(Continued)

OTHER PUBLICATIONS

Lumileds Lighting, LLC, Luxeon 1-Watt Emitter, Technical Data DS25, dated Jul. 2002, pp. 1-12, San Jose, CA, USA.

*Primary Examiner*—John Anthony Ward
*Assistant Examiner*—Jacob Y. Choi
(74) *Attorney, Agent, or Firm*—Michael Best & Friedrich LLP

(57) ABSTRACT

A radiation-emitting device comprising a side-emitting optoelectronic device having an upper surface and a heat sink in thermal conductivity with the side-emitting optoelectronic device. A reflector at least partially surrounds the side-emitting optoelectronic device. The reflector is positioned and shaped to reflect the emitted light substantially in an output direction. A reflective, non-transparent layer is disposed adjacent the upper surface of the side-emitting optoelectronic device.

27 Claims, 3 Drawing Sheets

U.S. PATENT DOCUMENTS

2002/0070449 A1 6/2002 Yagi et al.
2002/0125485 A1 9/2002 Steigerwald et al.
2002/0135997 A1 9/2002 Lammers
2002/0163808 A1 11/2002 West et al.
2002/0163810 A1 11/2002 West et al.
2002/0171087 A1 11/2002 Krames et al.
2003/0063476 A1 * 4/2003 English et al. ..... 362/545
2003/0137838 A1 * 7/2003 Rizkin et al. ..... 362/240
2003/0189832 A1 * 10/2003 Rizkin et al. ..... 362/302
2004/0114358 A1 * 6/2004 Storey et al. ..... 362/191

* cited by examiner

SIGN ILLUMINATION SYSTEM

BACKGROUND OF THE INVENTION

The present invention relates to light fixtures, and particularly to light fixtures used in signs and displays. More particularly the present invention relates to illuminated signs that use radiation-emitting diodes as the light source.

It is well known that illuminated signs attract more attention than unlit signs. As such, businesses prefer illuminated signs for the purpose of attracting consumers or for advertising. One common illuminated sign is a box sign. A typical box sign includes a housing that supports a plurality of light sources. The housing is covered by a panel or sign facia that conveys the desired image to the consumer. Commonly, these light fixtures include conventional light sources such as incandescent, fluorescent, or neon lights that provide the desired illumination. However, these light sources can have several drawbacks. Some of these light sources consume large amounts of electricity making them expensive to operate; particularly for outdoor signs that are illuminated for long periods of time. Conventional light sources can generate a significant amount of heat that is not easily dissipated. In addition, conventional incandescent light sources have a short life and/or are susceptible to damage when compared to some less conventional light sources, and as such must be inspected and replaced periodically. Neon or fluorescent lights require expensive power supplies, and typically operate at a high voltage.

SUMMARY

The present invention provides a radiation-emitting device comprising a side-emitting optoelectronic device having an upper surface, and a heat sink in thermal conductivity with the side-emitting optoelectronic device. The optoelectronic device may be a light-emitting diode, laser diode, or comparable low power point source of light. A reflector at least partially surrounds the side-emitting optoelectronic device. The reflector is positioned and shaped to reflect the emitted light substantially in an output direction. A non-transparent layer is disposed adjacent the upper surface of the side-emitting optoelectronic device.

In another construction, the invention provides a light fixture comprising a housing and a translucent output panel connected to the housing. A light-emitter is supported by the housing. The light-emitter includes a side-emitting optoelectronic device having an upper surface. A non-transparent layer is positioned between the translucent panel and the upper surface of the side-emitting optoelectronic device.

BRIEF DESCRIPTION OF THE DRAWINGS

The detailed description particularly refers to the accompanying figures in which.

DETAILED DESCRIPTION OF THE DRAWINGS

Before describing the invention in detail, it should be noted that unless otherwise specified, the term "light-emitting diode" (LED) as used herein includes a light-emitting diode and a corresponding refractor or optic, including diodes that emit infrared and ultraviolet radiation. The light-emitting diode itself is an electrical device that produces light in response to an applied current and voltage. For purposes of this application, another term for "light-emitting device" such as an LED is "radiation-emitting device". The optic receives the light generated by the diode portion of the LED and refracts, reflects, or otherwise directs the light such that it is emitted from the optic in the desired pattern.

Furthermore, while the preferred constructions employ a LED as the light source, other optoelectronic light sources (electronic devices that emit light when powered) may be used and will function with the present invention. For example, radiation-emitting devices such as polymer or organic radiation-emitting devices or electroluminescent devices could be used with the present invention.

It should also be noted that the term "intensity" as used herein is meant to describe the luminous flux (lumens) produced by the light as measured across the area through which the light is emitted.

Figure 1:
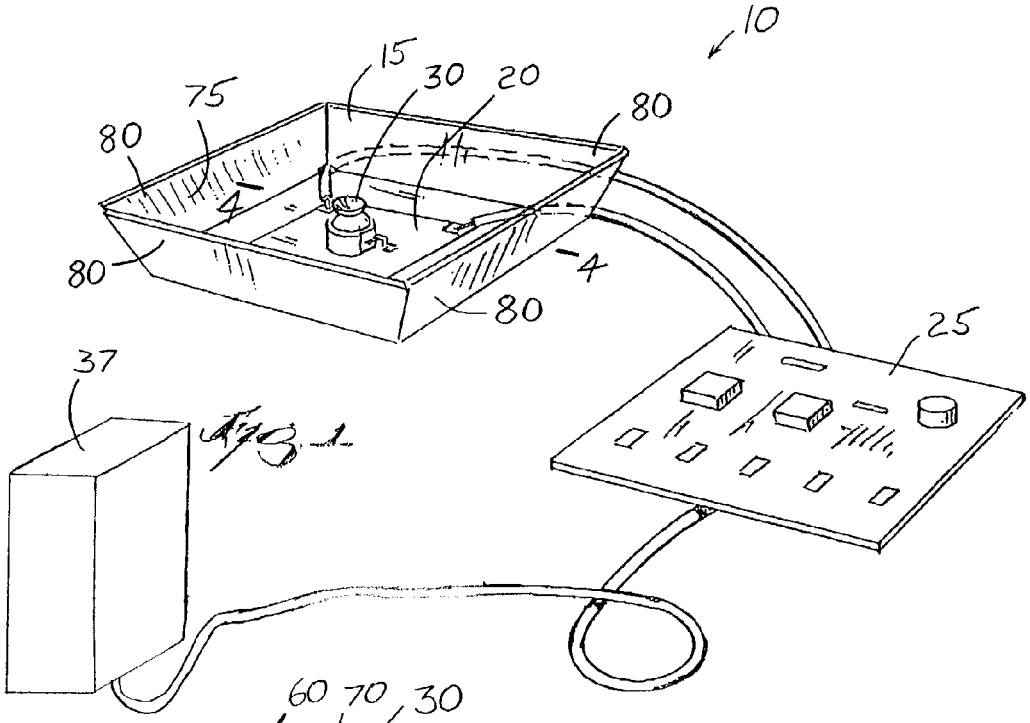
FIG. 1 is a perspective view of a radiation-emitting device and controller embodying the invention.

With reference to FIG. 1, a single radiation-emitting device 10 is shown in detail. The radiation-emitting device 10 includes a reflector 15, a circuit board 20, a controller 25, and a light-emitting diode (LED) 30. The controller 25 includes voltage and/or current regulators that can be adjusted to maintain the desired voltage and/or current flow to the LED 30. In other constructions, voltage and/or current control circuitry is housed elsewhere in the circuit, such as on the circuit board 20. Controller 25 may also include a microcontroller or similar circuit to enable the LEDs 30 to be sequenced, flashed, or otherwise controlled.

Figure 2:
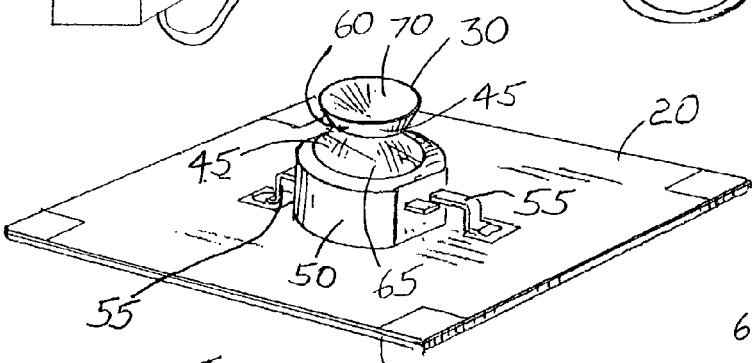
FIG. 2 is an enlarged perspective view of a side-emitting radiation-emitting diode and a circuit board of FIG. 1.

The circuit board 20 (shown in FIG. 2) includes a heat sink 35 that helps dissipate the excess heat generated by the LED 30. The heat sink 35 is large enough to dissipate the excess heat generated by the LED 30 during operation and maintain the LED 30 below a maximum operating temperature. If the heat sink 35 does not dissipate sufficient heat, the life and the output of the LED 30 may be reduced. The heat sink 35 is generally metallic, with aluminum being the preferred material. However, other materials that conduct heat are suitable choices for the heat sink 35. In some constructions, the heat sink 35 includes irregular edges or surfaces that increase the overall surface area of the heat sink 35, and thus the heat dissipation capacity. In still other constructions, unobtrusive fins or other protrusions project from a surface of the heat sink to further improve the heat dissipation of the heat sink. Fans, heat pipes, fluids, or phase change materials may also be employed to remove excess heat from higher wattage LEDs.

The LED 30 attaches to the circuit board 20 in any suitable manner. For example, the LED 30 could be soldered to the circuit board 20. Alternatively, thermally conductive epoxy may be used to attach the LED 30 to the circuit board 20.

Figure 3:
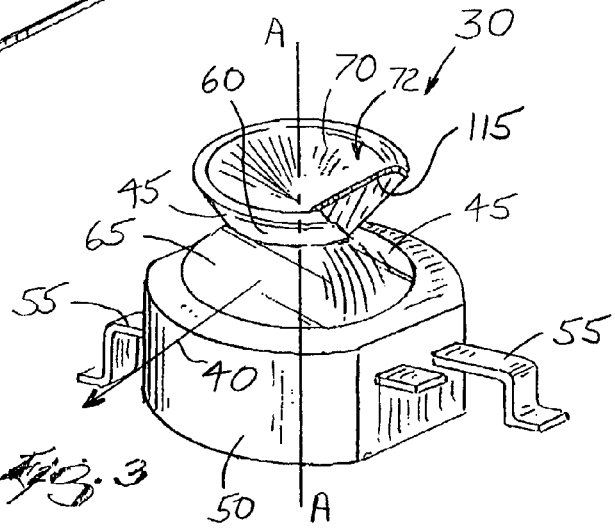
FIG. 3 is an enlarged perspective view of the side-emitting light-emitting diode of FIG. 2.

The LED 30 resides within the reflector 15 as shown in FIGS. 1, 4, 6, and 7 and produces a highly luminous beam of light 40 when connected to a proper DC power supply 37. The shape of the LED 30, illustrated best in FIG. 3, is adapted to emit the beam of light 40 in a generally radial direction out of radiation-emitting surfaces 45 that extend 360 degrees around the central axis A—A of the LED 30. In a preferred embodiment, little or no light escapes out of the LED 30 in a direction parallel to axis A—A; instead, the light is emitted in a substantially radial direction around the LED 30. A substantial portion of the emitted light leaves the LED 30 along paths that are substantially normal to axis A—A. However, some light does leave the LED 30 along paths that are not substantially normal to axis A—A.

The LED 30 of FIG. 3 includes a base 50, two leads 55, an upper frustoconical portion 60, and a lower domed portion 65. A semiconductor junction (not shown) disposed within the base 50 (or within the optic made up of the upper frustoconical portion 60 and the lower domed portion 65) produces light when the proper current and voltage are applied. The light exits the junction along various paths. The two leads 55 provide for the electrical connection between a DC power source 37 and the junction.

The frustoconical portion 60 includes a concave top surface 70 that internally reflects light traveling within the LED 30 so that the light is output through the radiation-emitting surfaces 45. A truncated substantially spherical portion defines the lower domed portion 65. The upper frustoconical portion 60 and the lower domed portion 65 are substantially transparent such that light can travel within them without significant losses in intensity. The shape of the upper frustoconical portion 60 and the lower domed portion 65, in combination with the material used, cause the light produced by the semiconductor junction to be redirected out the radiation-emitting surfaces 45 of the LED 30. LEDs 30 of this type are commercially available from manufacturers such as Lumileds Lighting, LLC of San Jose, Calif. and marketed under the trade name LUXEON (side emitting). To further enhance the side-emitting qualities of the LED 30 a non-transparent (preferably reflective) layer 72 is positioned on or above the top surface 70. This layer 72 is discussed in greater detail below with regard to FIG. 6.

While the LED 30 described is a particular shape, other shapes employing other materials will also produce the desired pattern of light. In addition, other side-emitting optoelectronic devices will also function with the present invention. For example, a standard LED could be constructed with a reflecting or refracting device that directs the light in the desired directions.

For use as a light source in signage and displays, a 1-watt LED 30 is generally adequate. However, some applications may require higher wattage LEDs 30. For example, large signs or signs positioned high off the ground may require 5-watt or larger LEDs 30 to be adequately illuminated.

When used in sign applications, an LED 30 that emits substantially white light is preferred. When other colors are desired, color filters, signs, or lenses may be employed. Alternatively, monochromatic LEDs 30 that emit light of the wavelength corresponding to the desired color can be used.

Two or more LEDs 30 may also be used in combination to produce light of the desired color. For example, a red LED in combination with a blue LED will produce magenta light through a diffusive reflector or lens. In fact, a red LED, a blue LED, and a green LED, can be used in combination to produce almost any desired color by varying the intensity of the individual LEDs.

In still other construction, two differently colored LEDs are disposed within a single sign. The two LEDs are sequenced on and off to produce alternating colored lights.

Figure 4:
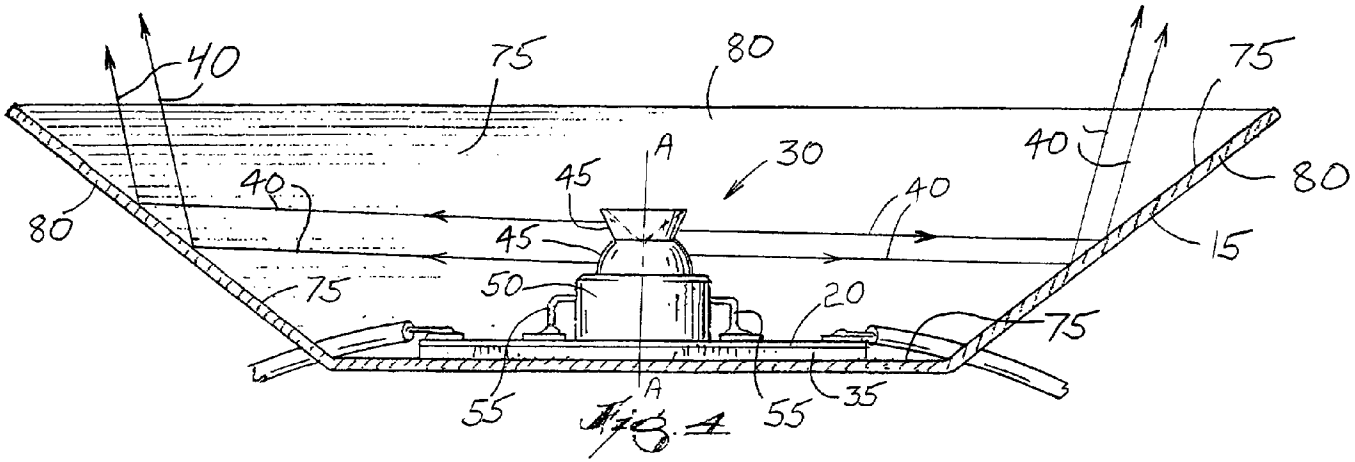
FIG. 4 is a sectional view of the radiation-emitting device taken along line 4—4 of FIG. 1.

The reflector 15 can be formed into any polygonal shape (e.g., four-sided, five-sided, six-sided and the like) or can be round, oval, elliptical, or irregular in shape. In fact, reflectors 15 can be formed to any desired shape, depending on the particular application. In addition, while FIGS. 1 and 4 illustrate a single LED 30 centered within the single reflector 15, two or more LEDs 30 could be arranged within the single reflector 15. For example, a long rectangular reflector could include LEDs 30 spaced along the length of the reflector. In another example an annular reflector (such as may be used to form the letter "O") includes LEDs spaced at different angular positions along a radius.

The reflector 15 includes an inner surface 75 that reflects a large percentage of the incident light in an output direction. The output direction is generally away from the radiation-emitting device 10 substantially along axis A—A. In one construction, the reflector 15 is formed from a stamped metal plate. The inner surface of the metal plate is painted white to better reflect the light emitted by the LED 30. The painted surface has the advantage of being a diffuse reflector. As such, the reflector provides more even light distribution on the sign by diffusing the reflected light. In other constructions, other materials are used to make the reflector or to improve the reflectivity of the inner surface 75. For example, a plastic reflector with a reflective metallic inner surface is well suited to reflecting the light emitted by the side-emitting LED 30.

Figure 7:
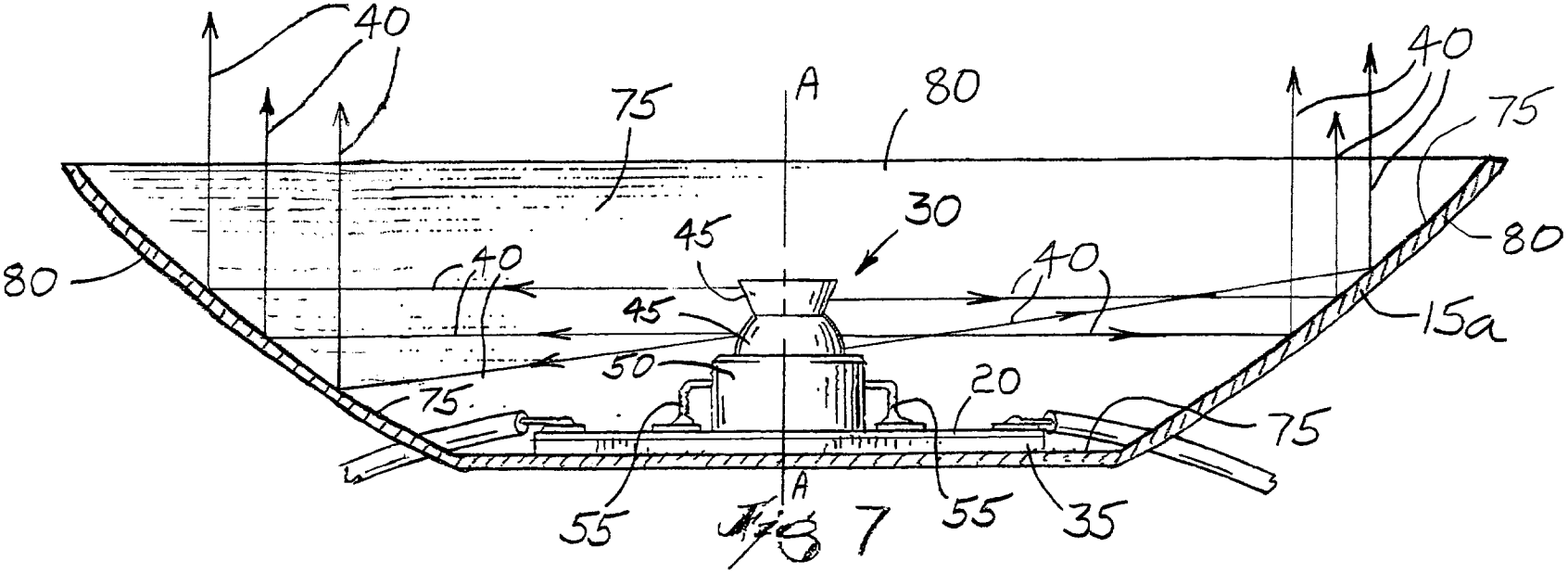
FIG. 7 is a sectional view of another radiation-emitting device including a parabolic reflector.

With continued reference to FIGS. 1 and 4, the reflector 15 includes at least one angled side 80 that aids in reflecting the light in the desired direction. Light emitted by the LED 30 reflects off the angled surface 80 and is redirected substantially vertically as illustrated in FIG. 4. FIG. 7 illustrates a parabolic reflector 15*a* that reflects the light in a column (i.e., collimates the light) directed away from the reflector 15*a*.

As can be seen, there are many ways to reflect the light along the desired path and only a few examples have been illustrated. Other shaped reflectors 15 are known and could be used with the present invention to achieve the desired results. Therefore, the reflector 15 should not be limited to the examples illustrated herein.

Figure 5:
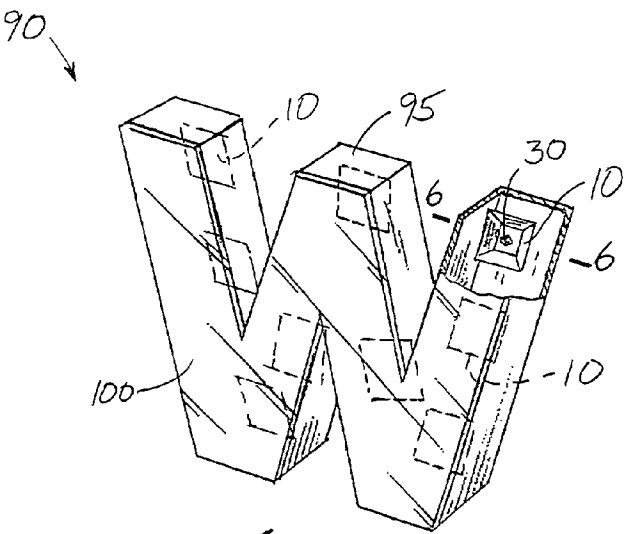
FIG. 5 is a partially broken away perspective view of a sign including the radiation-emitting device of FIG. 4.

Turning now to FIG. 5, a sign 90 including a plurality of radiation-emitting devices 10 is illustrated. The sign 90 includes a housing 95 that substantially supports the radiation-emitting devices 10 and a cover panel 100 that covers the front of the sign 90. The cover panel 100 is translucent such that most of the light emitted by the LEDs 30 passes through it. In many constructions, the cover panel 100 acts as a diffuser, diffusing the light to create a uniform distribution of light output through the panel 100. In other constructions, the cover panel 100 is transparent. In still other constructions, the cover panel 100 is luminescent such that the cover panel 100 emits additional light when illuminated by the radiation-emitting devices 10.

Figure 6:
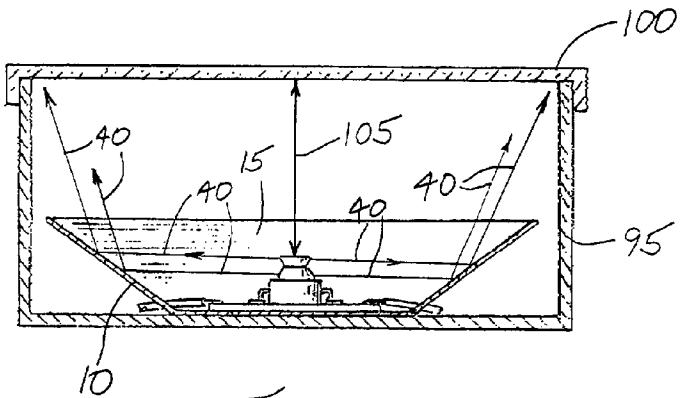
FIG. 6 is a cross sectional view of a sign taken along line 6—6 of FIG. 5.

As shown in FIG. 6, the reflectors 15 and LEDs 30 are positioned a distance 105 from the cover 100 to allow the entire cover 100 to be substantially illuminated by light reflected from the radiation-emitting devices 10. To prevent bright spots immediately above each LED 30, the non-transparent (preferably reflective) layer 72 is positioned between the LED 30 and the cover 100. With reference to FIG. 3, the reflective non-transparent layer is illustrated as including paint 115 applied to the top surface 70 of the LED 30. The paint 115 reduces the amount of light that escapes from the top of the LED 30 and reduces the likelihood of a bright spot on the cover panel 100. In other constructions, other substances such as tape, reflective plastic, and the like cover the top surface 70 of the LED 30.

Returning to FIG. 6, the radiation-emitting device 10 is shown in its operating position within the sign 90. The LED 30 is positioned a distance 105 from the cover panel 100 to improve the uniformity of light output through the cover panel 100. In most constructions, the cover panel 100 is positioned 3 inches to 6 inches from the LED 30.

To further optimize the performance of the radiation-emitting devices 10, the controller 25 maintains the current and/or the voltage supplied to the LED 30 within a particular range. For white LEDs 30, the controller 25 maintains a voltage at each LED 30 at approximately 3.4 Volts. The controller 25 also maintains the current through each LED 30 between about 400 mA and 600 mA.

In operation, the DC power supply 37 provides the necessary power to operate the LED 30 through the controller 25. The DC power supply 37 can be used to convert standard AC power into DC power suitable for use with the radiation-emitting devices 10 and their controller 25 described herein. Although the DC voltage can vary, the controller 25 will maintain the specified current to the LEDs 30. Multiple LEDs 30 can be connected in series to controller 25 as long as efficient voltage sufficient voltage is provided by DC power supply 37.

Once power is applied to the LED 30, light is emitted as shown in FIGS. 4, 6, and 7. The light reflects off the reflector 15 and passes through the cover panel 100. Thus, a substantial portion of the light emitted by the LED 30 passes through the cover panel 100 to produce the lighted sign 90.

While the invention has been described as including an LED 30 that emits light of a certain wavelength, a person having ordinary skill in the art will realize that LEDs 30 emit a narrow distribution of light, typically in the visible portion of the spectrum. However, LEDs that emit significant light centered outside of the visible spectrum could also be used with the present invention, such as infrared or ultraviolet light. For example, so called "black light" signs could be powered by LEDs of the type described herein. "Black lights" emit light centered in the ultraviolet portion of the spectrum. Furthermore, LEDs that emit infrared light could be used in a device similar to the light fixture just described to produce a light fixture that is suited to applying heat or for night vision illumination. Therefore, the radiation-emitting device 10 described herein should not be limited to signs alone.

Although the invention has been described in detail with reference to certain preferred embodiments, variations and modifications exist within the scope and spirit of the invention as described and defined in the following claims.

What is claimed is:

1. A light fixture comprising:
a housing;
a translucent output panel connected to the housing;
at least two light-emitters supported by the housing, each of the light-emitters including:
a side-emitting optoelectronic device having an upper surface;
a heat sink in thermal conductivity with the side-emitting optoelectronic device;
a reflector at least partially surrounding the side-emitting optoelectronic device, the reflector positioned and shaped to reflect the emitted light substantially in an output direction; and
a non-transparent layer positioned between the translucent panel and the upper surface of the side-emitting optoelectronic device, wherein the side-emitting optoelectronic device further comprises a truncated substantially spherical portion and a frustoconical portion having a concave top, the frustoconical portion disposed adjacent the truncated substantially spherical portion.

2. The light fixture of claim 1, wherein the optoelectronic device includes a side-emitting light-emitting diode.

3. The light fixture of claim 1, further comprising a reflector at least partially surrounding the side-emitting optoelectronic device, the reflector positioned and shaped to reflect the emitted light substantially towards the output panel.

4. The light fixture of claim 3, wherein the reflector is polygonal and includes at least one angled side.

5. The light fixture of claim 3, wherein the reflector is substantially parabolic.

6. The light fixture of claim 3, wherein the reflector substantially collimates the emitted light.

7. The light fixture of claim 1, wherein the translucent panel is spaced a distance from the side-emitting optoelectronic device, the distance being between about 3 inches and 6 inches.

8. The light fixture of claim 1, further comprising a heat sink positioned in thermal conduction with the side-emitting optoelectronic device.

9. The light fixture of claim 8, wherein the heat sink at least partially supports the side-emitting optoelectronic device.

10. The light fixture of claim 8, wherein the heat sink includes a circuit board having a metallic substrate.

11. The light fixture of claim 10, wherein the metallic substrate includes aluminum.

12. The light fixture of claim 1, wherein the non-transparent layer is applied directly to the upper surface of the side-emitting optoelectronic device.

13. The light fixture of claim 1, wherein the optoelectronic device outputs a plurality of wavelengths which comprise white light.

14. The light fixture of claim 1, wherein the output panel contains a fluorescent material, and wherein the optoelectronic device outputs ultraviolet radiation that excites the fluorescent material.

15. A light fixture comprising:
a housing;
a translucent output panel connected to the housing;
at least two light-emitters supported by the housing, each of the light-emitters including:
a side-emitting optoelectronic device having an upper surface;
a heat sink in thermal conductivity with the side-emitting optoelectronic device;
a reflector at least partially surrounding the side-emitting optoelectronic device, the reflector positioned and shaped to reflect the emitted light substantially in an output direction; and
a non-transparent layer positioned between the translucent panel and the upper surface of the side-emitting optoelectronic device, wherein the non-transparent layer is applied directly to the upper surface of the side-emitting optoelectronic device, and wherein the non-transparent layer includes paint applied to the upper surface of the side-emitting optoelectronic device.

16. A light fixture comprising:
a housing;
a translucent output panel connected to the housing;
at least two light-emitters supported by the housing, each of the light-emitters including;
a side-emitting optoelectronic device having an upper surface;

a heat sink in thermal conductivity with the side-emitting optoelectronic device;

a reflector at least partially surrounding the side-emitting optoelectronic device, the reflector positioned and shaped to reflect the emitted light substantially in an output direction; and a non-transparent layer positioned between the translucent panel and the upper surface of the side-emitting optoelectronic device, wherein the optoelectronic device outputs substantially monochromatic light.

17. A light fixture comprising:

a housing having a base and at least one wall;

a translucent panel coupled to the housing and spaced a distance from the base, the translucent panel and the housing cooperating to define a light space; and a plurality of light-emitters supported by the housing and positioned to emit light through the translucent panel, each light-emitter including:

a side-emitting optoelectronic device having an upper surface;

a non-transparent layer applied directly to the upper surface of the side-emitting optoelectronic device; and a reflector at least partially surrounding the side-emitting optoelectronic device, the reflector positioned and shaped to reflect the emitted light substantially toward the translucent panel, wherein the non-transparent layer includes paint applied to the upper surface of the side-emitting optoelectronic device.

18. The light fixture of claim 17, wherein the optoelectronic device includes a side-emitting light-emitting diode.

19. The light fixture of claim 17, wherein the reflector is polygonal and includes at least one angled side.

20. The light fixture of claim 17, wherein the reflector is substantially parabolic.

21. The light fixture of claim 17, wherein the translucent panel is spaced a distance from the side-emitting optoelectronic device, the distance being between about 3 inches and 6 inches.

22. The light fixture of claim 17, further comprising a plurality of heat sinks, each heat sink positioned in thermal conduction with one of the side-emitting optoelectronic device.

23. The light fixture of claim 22, wherein each heat sink at least partially supports the side-emitting optoelectronic device.

24. The light fixture of claim 17, wherein the side-emitting optoelectronic device further comprises a truncated substantially spherical portion and a frustoconical portion having a concave top, the frustoconical portion disposed adjacent the truncated substantially spherical portion.

25. The light fixture of claim 17, wherein the optoelectronic device outputs a plurality of wavelengths which comprise white light.

26. The light fixture of claim 17, wherein at least one of the light-emitters emits light of a different color than the remaining light-emitters.

27. A light fixture comprising:

a housing having a base and at least one wall;

a translucent panel coupled to the housing and spaced a distance from the base, the translucent panel and the housing cooperating to define a light space; and a plurality of light-emitters supported by the housing and positioned to emit light through the translucent panel, each light-emitter including:

a side-emitting optoelectronic device having an upper surface; and a reflector at least partially surrounding the side-emitting optoelectronic device, the reflector positioned and shaped to reflect the emitted light substantially toward the translucent panel wherein the translucent panel contains a fluorescent material, and wherein the optoelectronic device outputs ultraviolet radiation that excites the fluorescent material.

* * * * *